US010165918B1

(12) United States Patent
Cowan

(10) Patent No.: US 10,165,918 B1
(45) Date of Patent: Jan. 1, 2019

(54) VACUUM ATTACHMENT

(71) Applicant: Theodore Cowan, Opelika, AL (US)

(72) Inventor: Theodore Cowan, Opelika, AL (US)

( * ) Notice: Subject to any disclaimer, the term of this patent is extended or adjusted under 35 U.S.C. 154(b) by 0 days.

(21) Appl. No.: 15/965,207

(22) Filed: Apr. 27, 2018

(51) Int. Cl.
*A47L 9/06* (2006.01)
*A46B 9/02* (2006.01)

(52) U.S. Cl.
CPC ..... *A47L 9/0673* (2013.01); *A46B 9/028* (2013.01); *A47L 9/0606* (2013.01)

(58) Field of Classification Search
CPC ..... A47L 9/06; A47L 9/0673; A47L 9/0606; A46B 9/028
See application file for complete search history.

(56) References Cited

U.S. PATENT DOCUMENTS 1,770,668 A * 7/1930 Martinet ..... A47L 9/06 15/400
2,396,862 A * 3/1946 Linderoth ..... A47L 9/06 15/371
2,599,420 A * 6/1952 Westhoff ..... A47L 4/02 15/220.3
2,655,682 A * 10/1953 McCarthy ..... A47L 9/06 15/373
3,012,268 A * 12/1961 Descarries ..... A47L 9/06 15/417
3,013,295 A * 12/1961 Descarries ..... A47L 9/06 15/417
3,727,263 A * 4/1973 Johansson ..... A47L 9/06 15/373
3,768,114 A * 10/1973 Schwartz ..... A47L 9/02 15/319
3,818,540 A 6/1974 Martinec et al.
4,097,950 A 7/1978 Satterfield
4,113,376 A * 9/1978 Rodda ..... G03G 21/105 15/256.52
4,304,026 A * 12/1981 Borostyan ..... G03G 21/0035 15/308
4,653,137 A * 3/1987 Fleischhauer ..... A47L 9/06 15/374
6,802,104 B1 * 10/2004 Redd ..... A47L 9/0613 15/393
7,143,471 B2 12/2006 Moshenrose
2003/0167592 A1 * 9/2003 Egnatovich, Jr. ..... A47L 9/06 15/394

OTHER PUBLICATIONS

1x Double Roller Dusting cleaning Tool Household Carpet Table Sofa Brush. Product listing [online]. Copyright © 1995-2018 eBay Inc. [retrieved on Dec. 29, 2017]. Retrieved from the Internet: <URL: https://www.ebay.com/p/1x-Double-Roller-Dustingcleaning-Tool-Household-Carpet-Table-Sofa-Brush/811671625>.

Shark Rotator DuoClean Powered Lift-Away Speed—a complete review. Product review [online]. Copyright © 2014-2018 VacuumsGuide.com [retrieved on Dec. 29, 2017]. Retrieved from the Internet: <URL: hhttps://www.vacuumsguide.com/shark-rotator-duoclean-powered-lift-away-speed/>.

* cited by examiner

*Primary Examiner* — Weilun Lo
(74) *Attorney, Agent, or Firm* — Cramer Patent & Design, PLLC; Aaron R. Cramer

(57) ABSTRACT

A vacuum attachment for a ceiling has a vacuum attachment assembly at a lower opening at a first end and an upper opening at a second and opposite end. Disposed within the opening are a pair of fixed brushes. The attachment is configured to enable cleaning of textured ceiling surfaces in addition to more traditionally smooth ceiling surfaces.

18 Claims, 4 Drawing Sheets

VACUUM ATTACHMENT

RELATED APPLICATIONS

Not applicable.

FIELD OF THE INVENTION

The present invention relates generally to the field of cleaning head attachments for a vacuum cleaner.

BACKGROUND OF THE INVENTION

As most people know, ceilings are notoriously difficult surfaces to maintain and clean. Whether its applying a new coat of paint or dusting the surface, working overhead is both fatiguing and sometimes dangerous for depending on the height of the ceiling a ladder may have to be employed to reach the intended work area. This being the case working overhead on a ladder can be fraught with difficulty. As a result, most people avoid maintaining and/or cleaning ceilings entirely.

This reality is often regrettable because ceilings are usually quite visible to anyone entering a room and the condition of a ceiling can make or break the appearance of an entire room. An additional factor in the overall problematic nature of ceiling maintenance is that some ceilings have textures which make maintenance and repair even more difficult. Textured ceilings, often referred to as popcorn coated, provide thousands of nooks and spaces for dust to reside.

It has been observed that while traditional long handled dusting brushes may be able to reach the surface of a ceiling to facilitate cleaning—these traditional cleaning implements are largely ineffective at obtaining well cleaned textured surface ceiling. Additionally, such traditional cleaning implements require repetitive motions which while being performed overhead may prove fatiguing and injurious to the arms, neck and/or back of the person cleaning. A need therefore exists for a device which enables the cleaning of a ceiling, particularly a textured ceiling, in a manner which is safe, effective and efficient. The vacuum attachment fulfills this need.

SUMMARY OF THE INVENTION

The principles of the present invention provide for a such a cleaning implement capable of attachment to a vacuum hose attachment for a vacuum which is ideally suited for cleaning ceilings and textured ceilings in particular. It is therefore the intention of the inventor to provide a cleaning implement capable of attachment to a vacuum hose comprising an implement body, which in turn comprises a forward surface, a pair of side surfaces having proximal ends extending perpendicularly from opposing edges of the forward surface and parallel to each other, a rear surface, extending perpendicularly from distal ends of the pair of side surfaces and parallel with the forward surface, an upper opening, a lower opening and an interior which is in fluid communication with the upper opening and the lower opening.

The cleaning implement also comprises a coupling capable of removable attachment to the vacuum hose attachment to provide fluid communication with the interior, a first brush disposed between the pair of side surfaces adjacent the upper opening and a second brush disposed between the pair of side surfaces adjacent the first brush and adjacent the upper opening. The first brush and the second brush are configured to project from the upper opening.

The cleaning implement may also comprise a baffle structure, affixed to the implement body within the interior and subjacent to the first brush and the second brush. The baffle structure directs air flow and entrained debris towards the coupling. In a separate embodiment the implement may come with a baffle and may comprise a plurality of apertures aligned along a centerline of the baffle.

The pair of side surfaces may comprise rounded corners while the coupling may be offset at an angle from a vertical axial centerline of the pair of side surfaces and positioned towards the side of the forward surface. The angle may be 15°. The first brush and second brush may comprise a plurality of bristles affixed radially about a first rod.

The implement head may also be approximately 2½ inches in depth, nine inches in width, and four inches in height. The first brush may comprise approximately 1⅜ inches in diameter and seven inches in length. The second brush comprises approximately 1⅜ inches in diameter and seven inches in length.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
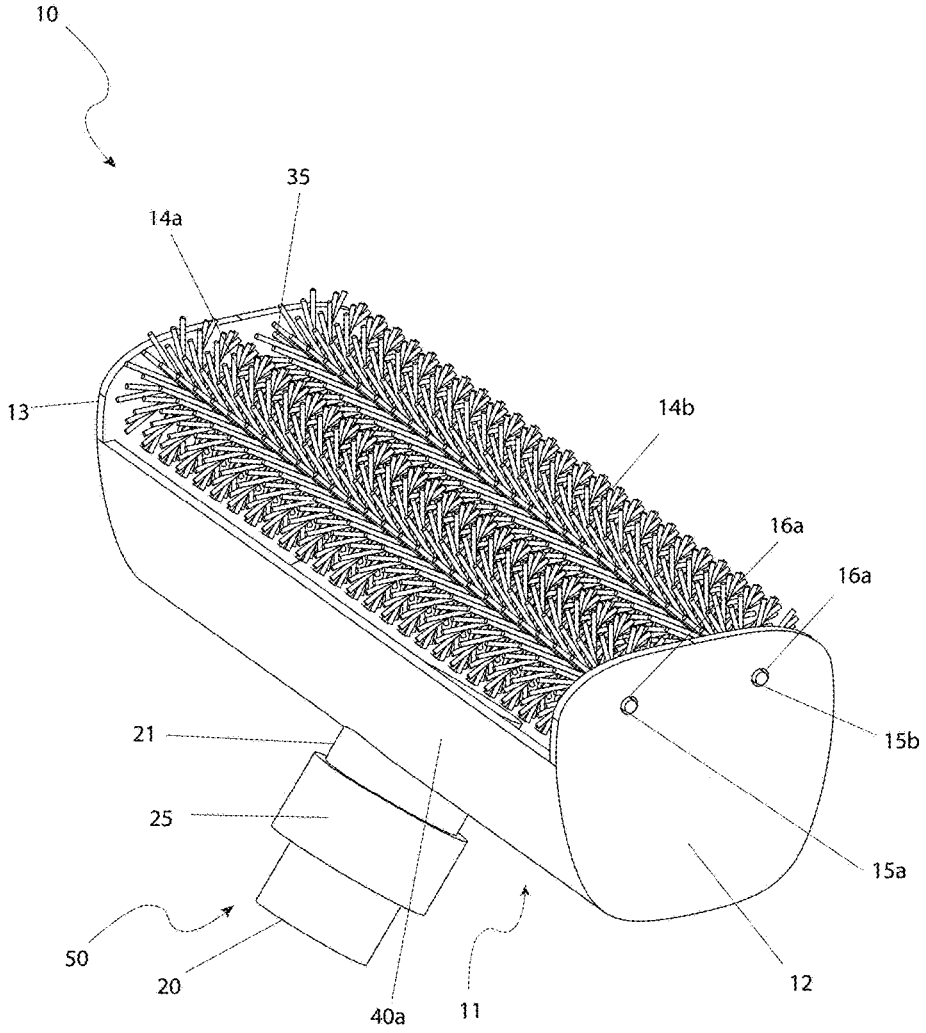
FIG. 1 is a perspective view of the vacuum brush attachment 10, according to the preferred embodiment of the present invention.
Figure 2:
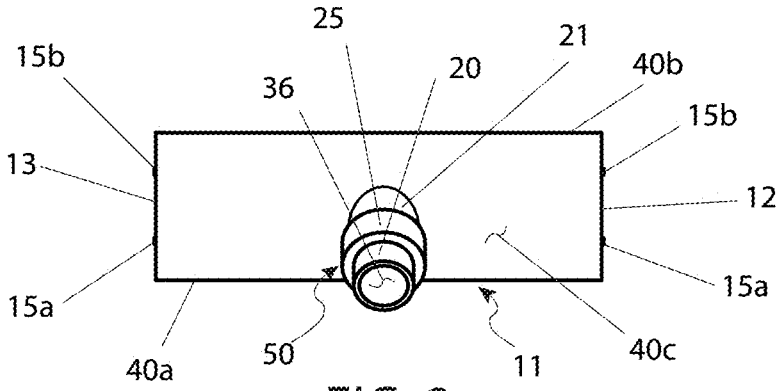
FIG. 2 is a bottom view of the apparatus 10, according to the preferred embodiment of the present invention.
Figure 3:
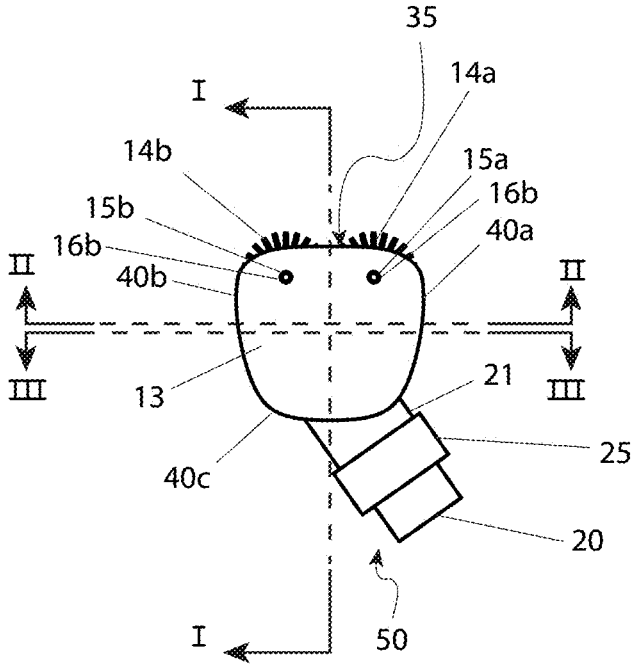
FIG. 3 is a first side view of the apparatus 10, according to the preferred embodiment of the present invention.
Figure 4:
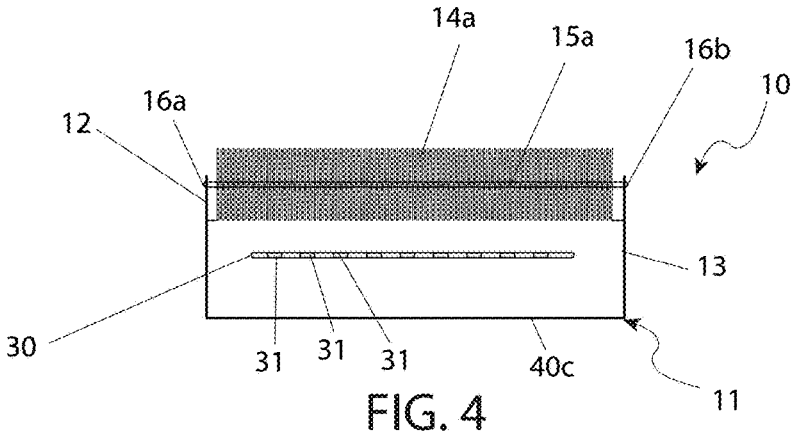
FIG. 4 is a sectional view of the apparatus 10 as seen along line I-I as shown in FIG. 3, according to the preferred embodiment of the present invention.
Figure 5:
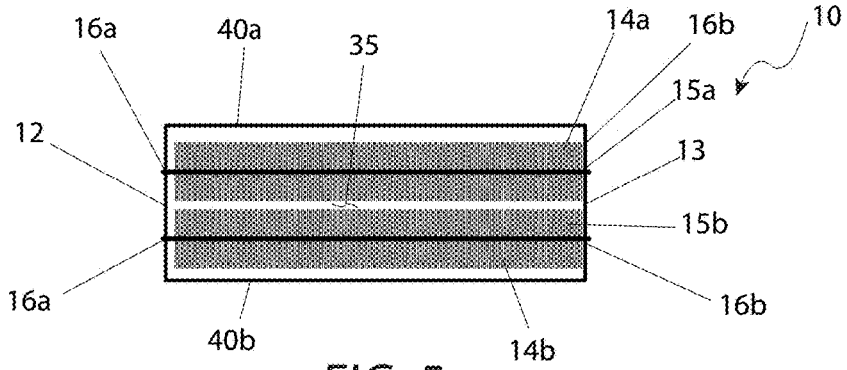
FIG. 5 is a sectional view of the apparatus 10 as seen along line II-II as shown in FIG. 3, according to the preferred embodiment of the present invention.
Figure 6:
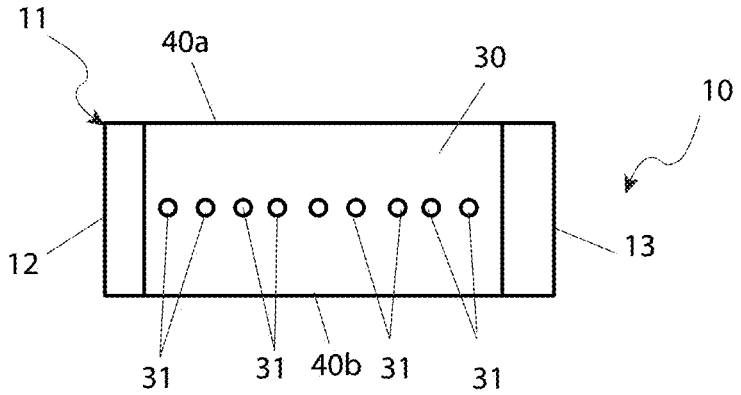
FIG. 6 is a sectional view of the apparatus 10 as seen along line as shown in FIG. 3, according to the preferred embodiment of the present invention; and, FIG. 7 is a top plan view of the baffle plate 30, according to the preferred embodiment of the present invention.

10 vacuum brush attachment
11 brush body
12 first end plate
13 second end plate
14*a* first brush
14*b* second brush
15*a* first rod
15*b* second rod
16*a* first end plate aperture
16*b* second end plate aperture
20 extension
21 inlet portion
25 attachment feature
30 baffle plate
31 aperture
35 upper opening
36 lower opening

40*a* front-facing portion
40*b* rear-facing portion
40*c* bottom portion
50 vacuum attachment assembly

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIGS. 1-7, a perspective view of a vacuum brush (herein also described as the "device") 10, which is preferably removably attachable to a suction end of a wand or hose. In turn, the wand or hose is then connected to a vacuum hose and terminates at a vacuum cleaning machine. The device 10 is suited for cleaning the surfaces of a ceiling, and particularly suited for cleaning ceilings having irregular surfaces, such as popcorn-type or custom finishes. The device 10 presents generally a "U"-shaped brush body 11 with a pair of brushes 14*a*, 14*b* and a vacuum attachment assembly 50 attached thereto. Overall dimensions of the device 10 is viewed as nine inches (9 in.) wide and four inches (4 in.) tall. The overall depth of the device 10 is envisioned as being approximately two-and-a-half inches (2½ in.).

The brush body 11 has a front-facing portion 40*a*, a rear-facing portion 40*b*, and a bottom portion 40*c*. The bottom portion 40*c* is generally curvilinear and shaped similar to a "U" with flared leg portions. A first end of the bottom portion 40*c* flares outward from a vertical axial bisecting centerline and transitions into the front-facing portion 40*a* and a second end of the bottom portion 40*c* flares outward from the vertical axial bisecting centerline and transitions into the rear-facing portion 40*b*, such that the front-facing portion 40*a* and the rear-facing portion 40*b* are not parallel. A first end plate 12 is attached to and extends between perimeter first side edges of the front-facing portion 40*a* and rear-facing portion 40*b*. Similarly, a second end plate 13 is attached to and extends between perimeter second side edges of the front-facing portion 40*a* and rear-facing portion 40*b*. The end plates 12, 13, each have perimeter edges geometrically matching the perimeter edges of the front-facing portion 40*a*, rear-facing portion 40*b*, and bottom portion 40*c*, such that there is no communication with the environment at these locations. An upper opening 35 is in fluid communication with the interior of the brush body 11 and is defined between the front facing portion 40*a*, rear-facing portion 40*b*, first side plate 12, and second side plate 13.

A vacuum attachment assembly 50 is located on the bottom portion 40*c* of the brush body 11 and positioned subjacent either the forward-facing portion 40*a* or the rear-facing portion 40*b* relative to the common axial bisecting centerline aforementioned. It is appreciated that the vacuum attachment assembly 50 has a common axial bisecting centerline that is perpendicular to the surface of the bottom portion 40*c* to which it is attached. The vacuum tube attachment assembly 50 is positioned at an offset angle of approximately fifteen degrees (15°) from the axial bisecting centerline to provide for a more comfortable use of the device 10 under a wider range of usage conditions.

The vacuum attachment assembly 50 includes an inlet portion 21 having a first end attached to the bottom portion 40*c*. The inlet portion 21 is generally cylindrical in nature and has a hollow interior where the first open end is fluid communication with the interior of the brush body 11. The second open end of the inlet portion 21 is in fluid communication with a first open end of a similarly-sized and -shaped extension 20. The second open end of the extension 20 defines the lower opening 36. The extension 20 is configured to be inserted minimally within the vacuum cleaning machine wand or hose. Located at the transition point between the inlet portion 21 and the extension 20, and circumscribing an outer surface of each, is an attachment feature 25, which enables attachment of the vacuum attachment assembly 50, and hence the entire device 10, to the wand or hose of the vacuum cleaning machine.

A first rod 15*a* and a second rod 15*b*, each generally a cylindrical elongated metallic or plastic shaft, each has a first end attached to the first end plate 12 and a second end attached to the second end plate 13. The attachments to the end plates 12, 13 can be accomplished by fitting into a bore, or passing through an aperture 16*a*, 16*b* and fixed thereto. In such an embodiment, the first end plate 12 has a pair of first end plate apertures 16*a* and the second end plate 13 has a pair of second end plate apertures 16*b*. The affixing can be accomplished with an adhesive or a potting compound, such that the rods 15*a*, 15*b*, are fixed to the end plates 12, 13 and cannot move relative thereto. In another alternate embodiment, the rods 15*a*, 15*b*, are minimally flexible enough to enable bending to accomplish removable placement within apertures 16*a*, 16*b* located on the end plates 12, 13. Alternately, a fastener can be mounted to the exposed portions of the rods 15*a*, 15*b* to restrict rotational movement. The first and second rods 15*a*, 15*b* are each positioned parallel to each other along a common horizontal bisecting centerline and are spaced at a distance minimally greater than the overall diameter of the brushes 14*a*, 14*b*. The rods 15*a*, 15*b* are located near the tops of the end plates 12, 13 and when the brushes 14*a*, 14*b* are installed on the rods 15*a*, 15*b*, they cover a major portion of the upper opening 35.

A first brush 14*b* is removably or fixedly placed about the first rod 15*a* and a second brush 14*b* is removably or fixedly placed on the second rod 15*b*. The brushes 14*a*, 14*b* are preferably a cylindrical body, having a core with a through bore encompassing and securely attaching to the respective rod 15*a*, 15*b*, and a plurality of brush elements affixed to the core. The brush elements can be a light or heavy nap, but preferably of a soft material to prevent marring of the surface it contacts. The length of the brushes 14*a*, 14*b*, are smaller than the width of the respective rod 15*a*, 15*b*. The brushes 14*a*, 14*b*, therefore are each envisioned to have an approximate dimension of one-and-three-eighths inches (1⅜ in.) in diameter and seven inches (7 in.) long. There is a minimal amount of clearance between the outer limits of the first brush 14*a* and second brush 14*b* to enable loosened debris to pass through the upper opening 35 and traverse into the interior of the brush body 11. It is envisioned that the brushes 14*a*, 14*b*, are secured within the device 10 in a manner which prohibits the rotation of either. This feature provides for enhanced brushing of the ceiling as each brush 14*a*, 14*b*, are prohibited from giving way through unimpeded rotation as would result in a spinning brush.

Figure 7:
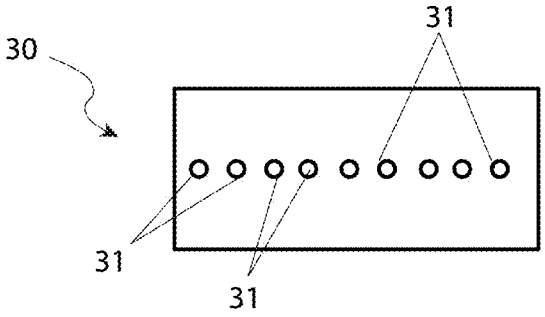

Referring now to FIG. 7, a baffle structure 30 is located within the interior of the brush body 11 and is affixed to and spans the distance between inner surfaces of the forward-facing portion 40*a* and the rear-facing portion 40*b*. The baffle 30 is placed directly subjacent the outer limits of the first brush 14*a* and second brush 14*b*, but superjacent of the input portion 21. The location of the baffle 30 helps direct the flow of air, as well as any captured dust, dirt, and debris, induce by the vacuum cleaning machine to be directed to the input portion 21 and lower opening 36 of the extension 20. The baffle 30 is of a minimal thickness and comprises a plurality of apertures 31 formed thereon. The apertures 31 may be randomly located, positioned in a grid, or aligned along a common bisecting centerline. Preferably, the apertures 31 are aligned along a common bisecting centerline with respect to the apertures 31 and the baffle 30.

It is envisioned that the brush body 11, the end plates 12, 13, and the baffle 30 would be made of impact resistant plastic in an injection molding process. However, other materials such as stamped steel may also be used, as and such, material or method of construction shall be interpreted as a limiting factor of the present invention.

2. Operation of the Preferred Embodiment

The preferred embodiment of the present invention can be utilized by the common user in a simple and effortless manner with little or no training. It is envisioned that the apparatus 10 would be constructed in general accordance with FIGS. 1-7. The user would procure the apparatus 10 through normal procurement channels.

After procurement and prior to utilization, the apparatus 10 would be prepared in the following manner: the device 10 would be attached to the wand or hose of the vacuum cleaning machine by inserting the extension 20 into the wand or hose; and, the attachment feature 25 is utilized to removably attach to the device 10 to the wand or hose.

During utilization of the apparatus 10, the following procedure would be initiated: the vacuum cleaning machine is energized, thereby inducing a vacuum pressure through the wand or hose, vacuum attachment assembly 50, and the interior of the brush body 11; the device 10 is motioned over the surface to be cleaned, such as a ceiling, wherein action of the brushes 14*a*, 14*b* will dislodge any dust, dirt, and debris; such loosened debris then enters the device 10 through the upper opening 35; and, the loosened debris passes through the interior of the brush body 11, enters the inlet portion 21, passes into the extension 20, and exits the lower opening 36 to traverse into the vacuum wand or hose prior to entering the vacuum cleaner.

In embodiments that use a baffle structure 30, the baffle 30 helps to direct the flow of air and any entrained loosened debris from the upper opening 35 towards the input portion 21, and ultimately through the lower opening 36.

After use, the device 10 is separated from the vacuum wand or hose via release of the attachment feature 50 and stored until the next cleaning cycle is needed, thus repeating as above in a cyclical manner.

The foregoing descriptions of specific embodiments of the present invention have been presented for purposes of illustration and description. They are not intended to be exhaustive or to limit the invention to the precise forms disclosed, and obviously many modifications and variations are possible considering the above teaching. The embodiments were chosen and described to best explain the principles of the invention and its practical application, to thereby enable others skilled in the art to best utilize the invention and various embodiments with various modifications as are suited to the use contemplated.

What is claimed is:

1. A cleaning implement capable of attachment to a vacuum hose attachment, comprising:
- an implement body, comprising:
  - a forward surface;
  - a pair of side surfaces having proximal ends extending perpendicularly from opposing edges of said forward surface and parallel to each other;
  - a rear surface, extending perpendicularly from distal ends of said pair of side surfaces and not parallel with said forward surface;
  - an upper opening;
  - a lower opening; and,
  - an interior in fluid communication with said upper opening and said lower opening;
- a coupling capable of removable attachment to said vacuum hose attachment to provide fluid communication with said interior;
- a first brush disposed between said pair of side surfaces adjacent said upper opening;
- a second brush disposed between said pair of side surfaces adjacent said first brush and adjacent said upper opening;
- wherein said first brush and said second brush are configured to project from said upper opening; and,
- a baffle structure, affixed to said implement body within said interior and subjacent to said first brush and said second brush; wherein said baffle structure comprises a plurality of apertures aligned along a centerline of said baffle structure and directs air flow and entrained debris towards said coupling.

2. The cleaning implement of claim 1, wherein said pair of side surfaces comprise rounded corners.

3. The cleaning implement of claim 1, wherein said coupling is offset at an angle from a vertical axial centerline of said pair of side surfaces and positioned towards the side of said forward surface.

4. The cleaning implement of claim 3, wherein said angle is 15 degrees.

5. The cleaning implement of claim 1, wherein said first brush comprises a plurality of bristles affixed radially about a first rod.

6. The cleaning implement of claim 5, wherein said second brush comprises a plurality of bristles affixed radially about a second rod.

7. The cleaning implement of claim 1, wherein said implement head is approximately 2½ inches in depth, nine inches in width, and four inches in height.

8. The cleaning implement of claim 1, wherein said first brush comprises approximately 1⅜ inches in diameter and seven inches in length.

9. The cleaning implement of claim 8, wherein said second brush comprises approximately 1⅜ inches in diameter and seven inches in length.

10. A cleaning implement capable of attachment to a vacuum, comprising:

a vacuum hose attachment, having a first end capable of mechanical attachment to and fluid communication with a vacuum;

an implement body, comprising:

a forward surface;

a pair of side surfaces having proximal ends extending perpendicularly from opposing edges of said forward surface and parallel to each other;

a rear surface, extending perpendicularly from distal ends of said pair of side surfaces and not parallel with said forward surface;

an upper opening;

a lower opening; and, an interior in fluid communication with said front opening and said rear opening;

a coupling removably attached to a second end of said vacuum hose attachment to provide fluid communication with said interior;

a first brush disposed between said pair of side surfaces adjacent said upper opening;

a second brush disposed between said pair of side surfaces adjacent said first brush and adjacent said upper opening; and, a baffle structure, affixed to said implement body within said interior and subjacent to said first brush and said second brush;

wherein said baffle structure comprises a plurality of apertures aligned along a centerline of said baffle structure and directs air flow and entrained debris towards said coupling;

wherein said first brush and said second brush are configured to project from said upper opening.

11. The cleaning implement of claim 10, wherein said pair of side surfaces comprise rounded corners.

12. The cleaning implement of claim 10, wherein said coupling is offset at an angle from a vertical axial centerline of said pair of side surfaces and positioned towards the side of said forward surface.

13. The cleaning implement of claim 12, wherein said angle is 15 degrees.

14. The cleaning implement of claim 10, wherein said first brush comprises a plurality of bristles affixed radially about a first rod.

15. The cleaning implement of claim 12, wherein said second brush comprises a plurality of bristles affixed radially about a second rod.

16. The cleaning implement of claim 10, wherein said implement head is approximately 2½ inches in depth, nine inches in width, and four inches in height.

17. The cleaning implement of claim 10, wherein said first brush comprises approximately 1⅜ inches in diameter and seven inches in length.

18. The cleaning implement of claim 17, wherein said second brush comprises approximately 1⅜ inches in diameter and seven inches in length.

* * * * *